United States Patent [19]

Malinowski

[11] 4,169,027

[45] Sep. 25, 1979

[54] METHOD OF ELECTROCHEMICALLY PROCESSING THE SURFACE OF A WORKPIECE OF MOLYBDENUM OR OF AN ALLOY CONTAINING A HIGH PROPORTION OF MOLYBDENUM

[75] Inventor: Jerzy Malinowski, Jülich, Fed. Rep. of Germany

[73] Assignee: Kernforschungsanlage Jülich Gesellschaft mit beschränkter Haftung, Jülich, Fed. Rep. of Germany

[21] Appl. No.: 921,263

[22] Filed: Jul. 3, 1978

[30] Foreign Application Priority Data

Jul. 5, 1977 [DE] Fed. Rep. of Germany ..... 2730244

[51] Int. Cl.[2] ..... C25F 3/16; C25F 3/26

[52] U.S. Cl. ..... 204/129.85; 204/129.95

[58] Field of Search ..... 204/129.85, 129.95

[56] References Cited

U.S. PATENT DOCUMENTS

| | | | |
|---|---|---|---|
| 2,461,035 | 2/1949 | Clingan | 204/129.85 |
| 3,033,769 | 5/1962 | Cortes | 204/129.85 |
| 3,445,355 | 5/1969 | Woodberry et al. | 204/129.85 |
| 3,679,559 | 7/1972 | Blair et al. | 204/129.85 |

FOREIGN PATENT DOCUMENTS

| | | | |
|---|---|---|---|
| 49-32690 | 9/1974 | Japan | 204/129.95 |
| 250528 | 12/1970 | U.S.S.R. | 204/129.85 |

*Primary Examiner*—T. M. Tufariello

*Attorney, Agent, or Firm*—Becker & Becker, Inc.

[57] ABSTRACT

A method of electrochemically processing the surface of a workpiece of molybdenum or of an alloy containing a high proportion of molybdenum. The workpiece is connected as an anode in an electrolytic solution comprising 70 to 90% by volume of 2-propanol and 30 to 10% by volume of concentrated sulfuric acid.

2 Claims, No Drawings

METHOD OF ELECTROCHEMICALLY PROCESSING THE SURFACE OF A WORKPIECE OF MOLYBDENUM OR OF AN ALLOY CONTAINING A HIGH PROPORTION OF MOLYBDENUM

The present invention relates to a method of electrochemically processing the surface of a workpiece comprising molybdenum or an alloy having a high proportion of molybdenum.

Such methods are used if the surface of the metal is to be polished or cleaned, or if a specific profiling of the workpiece is to be achieved by specific removal of a portion of the surface.

From W. J. McG. Tegart, "The Electrolytic and Chemical Polishing of Metals in Research and Industry", Pergamon Press, London, 1959, pages 67 and 127, it is known to use an electrolytic solution of sulfuric acid, hydrochloric acid, and methanol for the surface processing of workpieces having a high molybdenum content, and to use an electrolytic solution of sulfuric acid and methanol for workpieces of molybdenum. A drawback of this method, however, is the use of the volatile and also poisonous methanol. From the same article, it is also known to use an electrolytic solution of sulfuric acid and distilled water. However, this electrolytic solution is only usable on molybdenum alloys which contain no carbides. In addition, with this variation of the method, the surface has a film of molybdenum oxide after the processing. In order to obtain a clean surface, this film must be removed by an additional step.

It is therefore an object of the present invention to provide a method which makes it possible to process workpieces of the above mentioned general type without having to use volatile or poisonous constituents in an electrolytic solution, as well as no longer requiring a posttreatment of the surface of the workpiece.

It is a further object of the present invention that this method be usable on workpieces of the above mentioned general type which also contain carbides.

The method of the present invention is characterized primarily by the use of an electrolytic solution containing 70 to 90% by volume of 2-propanol (isopropyl alcohol) and 30 to 10% by volume of concentrated sulfuric acid. Particularly good results are achieved with a mixture of 87.5% by volume of 2-propanol and 12.5% by volume of concentrated sulfuric acid.

When practicing the method of the present invention, the current density in the electrolyte can be as high as 50 A/dm$^2$. In this connection, the temperature of the electrolyte should not exceed 70° C. The method of the present invention is usable on workpieces of molybdenum as well as on alloys of the so-called TZM type which contain 0.40–0.50% by weight titanium
0.06–0.12% by weight zirconium
about 99.5% by weight molybdenum
0.01–0.04% by weight carbon
and less than 0.01% by weight of other impurities.

By using the method of the present invention, smooth layers of specified thickness are dissolved from the workpieces. The method can therefore also be used, for example, to remove the metal in layers in order to define the diffusion of fission products in the metal.

EXAMPLE

The method of the present invention was used to polish the inner surface of a pipe having an inner diameter of 25 mm and a composition of molybdenum
0.41% by weight titanium
0.082% by weight zirconium
0.014% by weight carbon
0.004% by weight iron
0.002% by weight silicon.

The pipe, which was closed at one end, was connected as an anode and was filled with an electrolytic solution comprising 87.5% by volume 2-propanol and 12.5% by volume concentrated sulfuric acid. A chromium nickel steel rod comprising 18% chromium and 8 to 10% nickel and having a diameter of 12 mm was used as a cathode. The rod was inserted into the pipe. The current density was about 5 A/cm$^2$, and the temperature of the electrolytic solution was about 22° C.

The polished inner surface of the pipe was smooth after carrying out the method of the present invention, and had only a very slight roughness (as determined by a metallographic test).

The present invention is, of course, in no way limited to the specific disclosure of the example, but also encompasses any modifications within the scope of the appended claims.

What I claim is:

1. A method of electrochemically processing the surface of a workpiece containing at least a molybdenum content of more than 99% by volume, which includes in combination the steps of:

connecting said workpiece as an anode; and supplying to said anode an electrolytic solution comprising 70 to 90% by volume of 2-propanol and 30 to 10% by volume of concentrated sulfuric acid.

2. A method in combination according to claim 1, in which said electrolytic solution comprises 87.5% by volume of 2-propanol and 12.5% by volume of concentrated sulfuric acid.

* * * * *